US005829379A

United States Patent [19]

von Spies

[11] Patent Number: 5,829,379

[45] Date of Patent: Nov. 3, 1998

[54] PLATE ANCHOR

[76] Inventor: Rudiger von Spies, Biedersteiner Str. 4, Munchen, Germany, 80802

[21] Appl. No.: 786,018

[22] Filed: Jan. 21, 1997

Related U.S. Application Data

[63] Continuation of PCT/EP95/02871 Jul. 20, 1995.

[30] Foreign Application Priority Data

Jul. 21, 1994 [DE] Germany ..... 44 25 930.1

[51] Int. Cl.[6] ..... B63B 21/32

[52] U.S. Cl. ..... 114/301; 114/304

[58] Field of Search ..... 114/293, 294, 114/301, 304, 306, 309

[56] References Cited

U.S. PATENT DOCUMENTS

| | | | |
|---|---|---|---|
| 3,774,569 | 11/1973 | Linnenbank | 114/208 R |
| 4,134,355 | 1/1979 | Carruthers | 114/297 |
| 4,154,186 | 5/1979 | van den Haak | 114/304 |
| 4,261,281 | 4/1981 | Petersen | 114/304 |

FOREIGN PATENT DOCUMENTS

| | | |
|---|---|---|
| 0 200 693 | 11/1986 | European Pat. Off. . |
| 626204 | 9/1927 | France . |
| 82851 | 8/1895 | Germany . |
| 1 145 047 | 3/1963 | Germany . |
| 51781 | 11/1966 | Germany . |
| 119022 | 10/1919 | United Kingdom . |
| 1 531 686 | 11/1978 | United Kingdom . |
| 2 196 918 | 5/1988 | United Kingdom . |

*Primary Examiner*—Stephen Avila

*Attorney, Agent, or Firm*—Jacobson, Price, Holman & Stern, PLLC

[57] ABSTRACT

The invention relates to a plate anchor having two anchor plates (2, 3) which are disposed in a plane and have between them a gap (12) which extends in the longitudinal direction of the anchor. An anchor shaft (1) is swingably mounted on pivot means which is disposed in the region of the end of the anchor plates (2, 3) which is directed generally away from the anchored vessel, whereby the shaft (1) can be swung into and through the gap (12). Each anchor plate (2, 3) has at least one forwardly disposed pointed claw element (21, 31) and at least one lagging pointed claw element (22, 32). All of the claw elements have lateral edges which are backswept in the direction generally away from the ship.

11 Claims, 1 Drawing Sheet

PLATE ANCHOR

This application is a PCT continuation application of PCT/EP95/02871, filed Jul. 20, 1995.

FIELD OF THE INVENTION

The present invention relates to a plate anchor, such as for anchoring a boat, ship or other vessel. More specifically, the present invention relates to a plate anchor having two spaced anchor plates which are disposed in a plane, with a central gap between them that extends in the longitudinal direction of the anchor, and having an anchor shaft which is swingably mounted on a pivot means disposed in the end region of the anchor plates directed generally away from the anchored vessel, whereby the shaft can be swung into and through the gap.

DESCRIPTION OF THE PRIOR ART

Known plate anchors are not equally effective in hard and soft anchoring media, for example, bottoms and soils, and when subjected to stress derived from drift, current or swinging of the anchored object, such anchors are readily dislodged from the anchoring medium.

SUMMARY OF THE INVENTION

The underlying problem addressed by the present invention is to devise a plate anchor which is effective and has high holding force in anchoring media of all types, in particular when subjected to appreciable horizontal tensile stress.

This problem is solved by a plate anchor of the general type described by incorporating into each anchor plate at least one forwardly disposed pointed claw element and at least one lagging pointed claw element, with all of the claw elements having lateral edges which are backswept in the direction generally away from the anchored vessel.

The basic advantage of the plate anchor of the present invention is that it has at least four flukes having edges which are backswept in the direction generally away from the ship or anchored vessel, wherewith the flukes can engage the anchoring medium simultaneously. The anchor is thus effective in a wide variety of anchoring media. In a hard anchoring medium, the forwardmost pointed claw element of each anchor plate engages the anchoring medium first, and then the lagging pointed claw element of each anchor plate is brought into engagement with the anchoring medium. The high resistance of the anchor is provided by the simultaneous engagement of the four pointed claw elements with backswept edges and by the fact that the resistance area increases as the engagement becomes deeper.

Advantageously, the plate anchor of this invention is caused to open under the influence of the inclined tension with a horizontal component exerted by the anchor chain fixed to the drifting, tending, and bobbing vessel sought to be anchored. Under such circumstances, the anchor develops a high and persistent holding resistance, because the laterally disposed pointed claw elements bear progressively increasing loads. Further, the anchor resists spinning out of engagement, because it has a wide surface of engagement between the outermost pointed claw elements. If the anchor does suffer a breaking of its hold, it rapidly re-engages, because at least one of the pointed claw elements will engage the anchoring medium regardless of the anchor attitude, i.e., the angle between the anchor plates and the underlying anchoring medium.

The anchor plates in accordance with the present invention also advantageously do not require a crossrod to achieve engagement, because the outer flukes ensure reliable engagement is regardless of the orientation conditions encountered during dragging of the anchor. Even without a crossrod, the anchor plates of the present anchor will reliably engage the anchoring medium in an even fashion, and the anchor will not tend to spin out of engagement under the influence of generally horizontal tension. In a preferred embodiment, a device having tooth-like claw members is provided in the region of the end of the anchor directed generally away from the anchored vessel which digs into the anchoring medium in a manner to augment the torque that urges the flukes of the anchor plates into engagement whereby they dig into the medium. In a further preferred refinement, a detent device is provided which delimits the angle by which the anchor shaft can swing away from the plane of the anchor plates, and a mechanism is provided to adjust that angle.

BRIEF DESCRIPTION OF THE DRAWINGS

The invention will be described in more detail hereinbelow with reference to the accompanying drawings.

DESCRIPTION OF THE PREFERRED EMBODIMENTS

Figure 1:
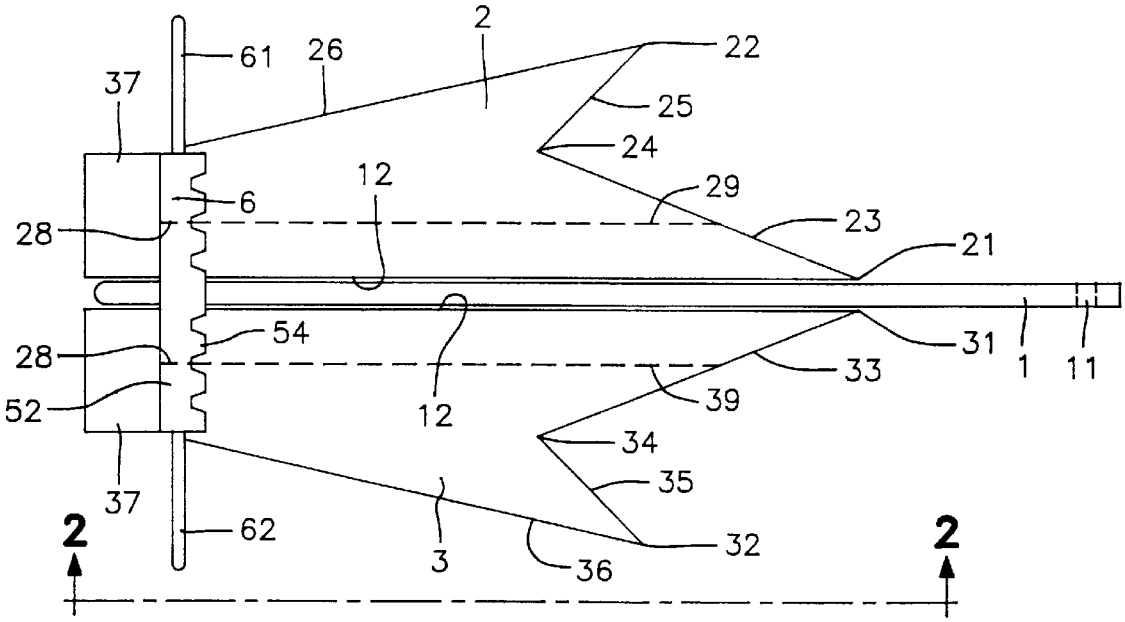
FIG. 1 is a plan view of a plate anchor in accordance with the present invention.
Figure 2:
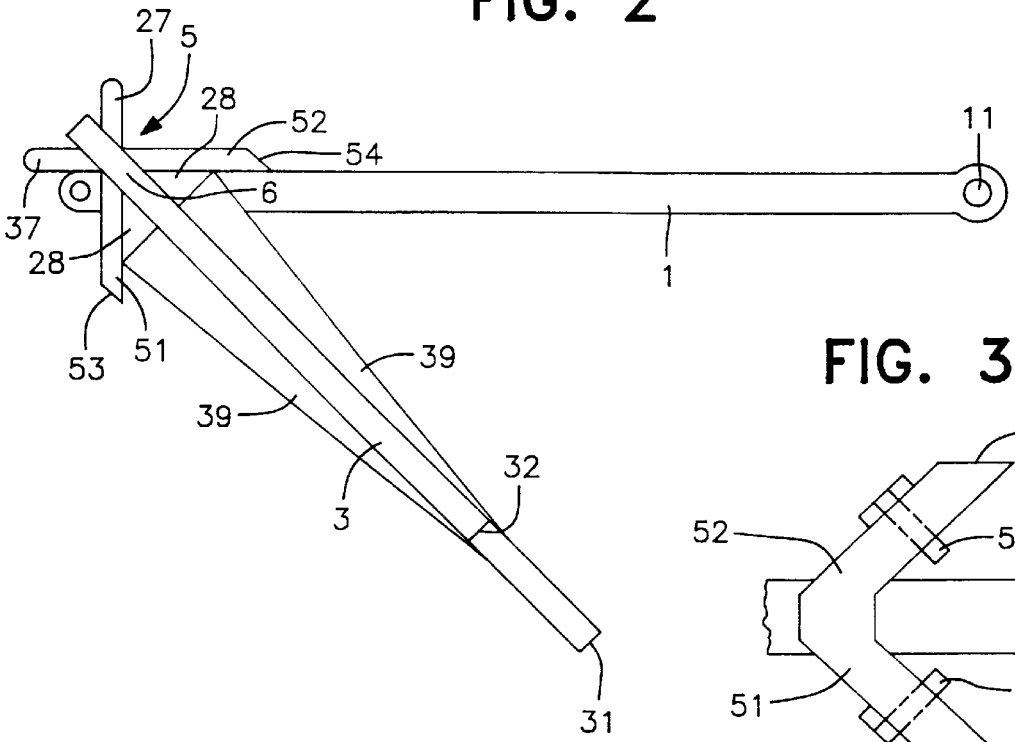
FIG. 2 is a lateral view of the plate anchor shown in FIG. 1.

In the embodiment illustrated in FIGS. 1 and 2, the plate anchor is essentially comprised of a divided anchor plate, or two anchor plates 2, 3 and an anchor shaft 1. The shaft 1 has an eye 11 or the like for fixing an anchor chain, at the end of the shaft 1 directed generally toward the ship or other vessel to be anchored. The two anchor plates 2, 3 are disposed in a single plane, and have between them a gap 12 which extends in the longitudinal direction. The shaft 1 is swingably mounted with respect to a pivot axle means 6 disposed at the end of the anchor directed generally away from the ship, whereby shaft 1 can be swung into and through the gap 12.

It is a particular feature of the present invention that each of the anchor plates 2, 3 has a fluke member having a forwardmost pointed claw element 21, 31 and at least one fluke member having a lagging pointed claw element 22, 32, and wherein the sides of said claw elements are generally backswept away from the ship. The forwardmost pointed claw elements 21, 31 are preferably disposed next to the shaft 2, and are mutually generally symmetrically disposed with respect to the vertical midplane of the anchor. The lagging pointed claw elements 22, 32 are disposed rearwardly of the forwardmost pointed claw elements 21, 31, where the rear end of the plate anchor is defined as the end directed generally away from the ship. The lagging elements 22, 32 are also disposed laterally outward of the forwardmost elements 21, 31 away from the longitudinal center line of the anchor. The two lagging elements 22, 32 are also mutually generally symmetrically disposed with respect to the vertical midplane of the anchor.

Preferably, the lagging pointed claw elements 22, 32 of the anchor plates 2, 3 are configured such that lateral edges 23, 33 of the respective anchor plates 2, 3 extend from the apex of the respective forwardmost claw elements, at 21, 31, at an angle such that the edges 23, 33 progress laterally outward with the progression rearwardly in the direction toward the end of the anchor which is directed generally away from the ship. At points 24, 34, each angularly backswept edge 23, 33 undergoes a transition to a lateral edge 25, 35 which progresses forwardly in the direction toward the end of the anchor which is directed generally toward the ship. The lateral edges 25, 35 terminate at the apex of the lagging pointed claw elements, at 22, 32; at which point another lateral edge 26, 36 extends to the rear end face of the anchor plates 2, 3, which rear end face is directed generally away from the ship. Preferably, the lateral edges 26, 36 are disposed at an angle such that they progress inwardly with progression rearward in the direction toward the end of the anchor which is directed generally away from the ship.

Thus, the two anchor plates 2, 3 when viewed in combination have a crown-like appearance. Known plate anchors, in contrast, reach their maximum width at the rearwardmost end. The advantage of the plate configuration of the present invention is that, once approximately half of the anchor plates 2, 3 have engaged the anchoring medium, the resistance against further engagement does not increase.

Preferably, a detent device 5 is provided which defines the range of angles within which the anchor plates 2, 3 are swingable with respect to the anchor shaft 1. Preferably, device 5 is comprised of detent plates 51, 52 mounted to the opposite sides of the anchor plates 2, 3, wherein the detent plates define an angle which is oriented symmetrically with respect to the longitudinal axis of said anchor plates 2, 3. The V-shape of the angle opens in the direction toward the end of the anchor directed generally toward the ship. The detent plates 51, 52 extend transversely in the lateral direction. When the anchor shaft 1 is swung outwardly, the shaft comes to abut one or the other of the detent plates 51, 52 in the region of the gap 12. Preferably, the angle between each detent plate 51, 52 and the longitudinal axis of the anchor plates 2, 3 does not exceed about 45 degrees. Also, preferably, each detent plate 51, 52 is welded to the anchor plates 2, 3 via triangular web members 28 disposed at equal distances in the lateral direction from the longitudinal axis of the anchor. Thus, the detent plates 51, 52 serve also to hold the anchor plates 2, 3 aligned in a single plane (see FIG. 2).

Figure 3:
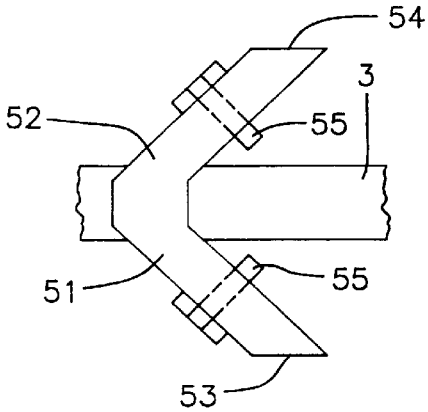
FIG. 3 is a view of a detail of a variant embodiment of a plate anchor in accordance with the present invention.

FIG. 3 shows a variant embodiment of the present invention wherein adjusting devices, preferably set screws 55, which extend through the detent plates, are provided to adjust the angle (or range of possible angles) between the detent plates 51, 52 and the anchor plates 2, 3.

Preferably, as shown, the detent plates 51, 52 also extend in the direction generally away from the anchored vessel. The projecting members constituting these extensions are designated with reference numerals 27 and 37, respectively. This provides a convenient means for standing the anchor vertically on a deck or the like, with the extensions 27, 37 serving as legs resting on the deck. The geometric form represented by the detent plates 51, 52 with their extensions 27, 37 is preferably that of rectangular plates which intersect at an angle. Appropriate gaps are provided in the extensions 27, 37 which gaps correspond to the gap 12.

The detent plates 51, 52 preferably extend in the lateral direction (transversely) over essentially the entire width of the anchor plates 2, 3. Thus, the detent plates hold the anchor plates together.

As seen from the drawings, the free edges of the detent plates 51, 52 are preferably beveled, and preferably have tooth-like claw members 53, 54 which dig into the anchoring medium when the anchor is dragged along the surface of the medium. This results in the anchor plates 2, 3 being rotated around the respective lateral (transverse) axis formed by the tooth-like members 53 or 54, whereby the anchor plates 2, 3 are urged against the anchoring medium, thereby promoting engagement of the pointed claw elements of the anchor plates, i.e., frontmost pointed claw elements 21, 31 and lagging pointed claw elements 22, 32, into the anchoring medium.

The pivot axle means 6 may be extended laterally outward to provide a crossrod 61, 62 to promote engagement of the flukes by urging a dragging anchor into a yawing rotation.

Each anchor plate 2, 3 may be provided with a plurality of additional pointed claw elements in addition to those illustrated by the numerals 21, 31 and 22, 32. The additional pointed claw elements should also have backwardly swept edges, and each successive additional claw element is disposed laterally outward of the preceding pointed claw element, thus farther from the longitudinal axis of the anchor. The disposition of the individual pointed claw elements and the details of the fluke configurations and, in particular, the longitudinal distance between the forwardmost pointed claw element and the various lagging pointed claw elements and the lateral distances between pointed claw elements, may be selected based on the specific requirements which the plate anchor must satisfy.

The material of construction of the described anchor is preferably steel or, in a lightweight version, aluminum. A lightweight version is possible because a high holding force is achieved as a result of the special engaging means and the enhanced digging effect of the four pointed claw elements 21, 31 and 22, 32.

The anchor plates 2, 3 may have reinforcing ribs and/or corrugations, in known fashion. Examples of reinforcing ribs 29, 39 are illustrated in FIGS. 1 and 2. The ribs extend perpendicularly to the plane of the anchor plates 2, 3, and are generally backswept at an angle from the leading edge, which edge is namely that generally closest to the anchored ship. Advantageously, the ribs 29, 39 are fastened, e.g., by welding, to the above-described stiffening web members 28 at the end face of the ribs 29, 39, respectively, which is generally farthest from the ship.

What is claimed as new is as follows:

1. A plate anchor having two anchor plates which are disposed in a plane and have between them a gap which extends in the longitudinal direction of the archor, and having an anchor shaft which is swingably mounted on pivot means disposed in the region of the end of the anchor plates which end is directed generally away from the anchored vessel, whereby the shaft can be swung into and through said gap, each anchor plate having at least one forwardly disposed pointed claw element and at least one lagging pointed claw element, and all of said claw elements having lateral edges which are backswept in the direction generally away from the anchored vessel, wherein a backwardly swept lateral edge of the respective anchor plate extends from an apex of the respective forwardmost claw element at an angle such that said edge progresses outwardly and rearwardly in the direction toward the end of the anchor directed generally away from the anchored vessel, said angularly backswept edge at a point undergoes a transition to a forwardly swept lateral edge which progresses outward in a forward direction toward the end of the anchor directed generally toward the anchored vessel, said forwardly swept lateral edge terminating at the apex of said lagging pointed claw element, and said respective transition points being mutually generally symmetrically disposed, a third lateral edge begins at the apex of said lagging pointed claw element and extends toward the rear end face of anchor plates which is directed generally away from the anchored vessel, said third lateral edge being disposed at an angle such that it progresses inward toward the anchor shaft with progression rearward in the direction toward the end of the anchor which is directed generally away from the anchored vessel.

2. A plate anchor according to claim 1 wherein the forwardly disposed pointed claw elements are disposed next to the gap, and are mutually generally symmetrically disposed with respect to the lateral direction.

3. A plate anchor according to claim 1, wherein each respective lagging pointed claw element is disposed successively laterally outwardly of each other with respect to the anchor shaft, and are also disposed rearwardly of the forwardmost pointed claw elements.

4. A plate anchor according to claim 1, wherein a detent device is provided at the end region of the anchor plates which is directed generally away from the anchored vessel, said detent device serving to delimit the range of angles within which the anchor shaft is swingable with respect to the anchor plates.

5. A plate anchor according to claim 1, wherein the detent device is comprised of detent plates mounted to the two sides of the anchor plates, and each of said detent plates extends across the gap in a cross-section taken generally transversely, said detent plates forming an angle the V-shape of which opens in the direction generally toward the anchored vessel, and said anchor shaft comes to abut the inner surfaces of the legs of said V-shape.

6. A plate anchor according to claim 4, wherein the detent device has adjusting means for adjusting said angle.

7. A plate anchor according to claim 6, wherein the adjusting means comprises adjusting screws which extend through the detent plates in such a way that the inner ends of said screws project in adjustable fashion from the inner surfaces of said detent plates.

8. A plate anchor according to claim 5, wherein the free edges of the detent plates are provided with tooth-like claw members which dig into the anchoring medium when the anchor is dragged along and produce a torque which urges the frontmost pointed claw elements and lagging pointed claw elements to dig into the anchoring medium.

9. A plate anchor according to claim 8, wherein the detent plates extend laterally over the entire width of the anchor.

10. A plate anchor according to claim 5, wherein the detent plates have extensions which extend in the direction generally away from the anchored vessel and which provide means of standing the anchor vertically.

11. A plate anchor according to claim 10, wherein gaps are provided in the extensions to accommodate the swinging of the anchor shaft.

* * * * *